US006889437B2

(12) United States Patent
Bader et al.

(10) Patent No.: US 6,889,437 B2
(45) Date of Patent: May 10, 2005

(54) SHAVING SYSTEM FOR A DRY SHAVER

(75) Inventors: Raoul Bader, Mainz (DE); Matthias Gradl, Sesslach (DE); Sebastian Hottenrott, Idstein (DE); Peter Junk, Seelenberg (DE); Christof Kleemann, Eschborn (DE); Michael Meiss, Friedberg (DE); Uwe Neumann, Wiesbaden (DE); Michael Odemer, Niddatal (DE); Andreas Reklau, Coburg (DE); Jens Störkel, Frankfurt (DE); Petri Toivanen, Kopenhagen (DK); Till Winkler, Kronberg (DE); Jürgen Wolf, Kriftel (DE)

(73) Assignee: Braun GmbH, Kronberg ( * ) Notice: Subject to any disclaimer, the term of this patent is extended or adjusted under 35 U.S.C. 154(b) by 29 days.

(21) Appl. No.: 10/653,402

(22) Filed: Sep. 2, 2003

(65) Prior Publication Data

US 2004/0040157 A1 Mar. 4, 2004

Related U.S. Application Data

(63) Continuation of application No. PCT/EP02/01189, filed on Feb. 6, 2002.

(30) Foreign Application Priority Data

Mar. 2, 2001 (DE) ..... 101 10 228

(51) Int. Cl.[7] ..... B26B 19/04

(52) U.S. Cl. ..... 30/43.1; 30/43.92

(58) Field of Search ..... 30/34.1, 43.62, 30/223, 225, 216, 364.51

(56) References Cited

U.S. PATENT DOCUMENTS

| | | | | |
|---|---|---|---|---|
| 3,589,005 A | | 6/1971 | Fischer et al. | |
| 4,628,606 A | * | 12/1986 | Hilfinger | 30/34.1 |
| 5,398,412 A | * | 3/1995 | Tanahashi et al. | 30/43.92 |

FOREIGN PATENT DOCUMENTS

| | | |
|---|---|---|
| DE | 43 12 060 C1 | 1/1994 |
| JP | 05293259 | 9/1993 |
| JP | 10235035 | 8/1998 |

* cited by examiner

*Primary Examiner*—Douglas D Watts
(74) *Attorney, Agent, or Firm*—Fish & Richardson P.C.

(57) ABSTRACT

A shaving system for a dry shaver has at least one long-hair cutter arranged between shaving units for short-hair cutting. The shaving units for short-hair cutting each include an upper blade and a lower blade, which can be moved relative to one another by a drive. The long-hair cutter is formed from at least two cutting elements that can be moved relative to one another and are arranged one beside the other. The cutting elements of the long-hair cutter are each of comb-like design, and their rows of cutting teeth, which are formed by tines, are oriented essentially perpendicularly to the skin which is to be shaved.

10 Claims, 5 Drawing Sheets

SHAVING SYSTEM FOR A DRY SHAVER

CROSS REFERENCE TO RELATED APPLICATION

This is a continuation of PCT application serial no. PCT/EP02/01189, filed Feb. 6, 2002, which claims priority from German application serial number 101 10 228.3, filed Mar. 2, 2001.

TECHNICAL FIELD

The invention relates to a shaving system for a dry shaver.

BACKGROUND

DE 43 12 060 C1 discloses a shaving system, of which the central cutter has an upper blade with draw-in elements that are oriented parallel to the skin which is to be shaved. Although such a shaving head, in practical usage, allows very good shaving results with, at the same time, very gentle treatment of the skin, it is possible, in some circumstances, during shaving of beard hairs which rest directly against the skin, for said hairs to be drawn in after a certain delay, with the result that the shaver has to pass over this area of skin a number of times in order to achieve an optimum shaving result.

The same applies to a shaving head according to DE-A 15 53 659, which discloses two long-hair cutters which are arranged between two short-hair cutting systems and are each swung out of the longitudinal plane of the shaver, through an angle of approximately 45°, in opposite directions of rotation.

SUMMARY

In an aspect, the invention features a shaving system for a dry shaver that has at least one long-hair cutter arranged between shaving units for short-hair cutting. The shaving units for short-hair cutting each include an upper blade and a lower blade, which can be moved relative to one another by a drive. The long-hair cutter is formed from at least two cutting elements that can be moved relative to one another and are arranged one beside the other. The cutting elements of the long-hair cutter are each of comb-like design, and their rows of cutting teeth, which are formed by tines, are oriented essentially perpendicularly to the skin which is to be shaved.

In some embodiments, the long-hair cutter includes three cutting elements, it being possible for the central cutting element to be moved relative to the two outer cutting elements. The central cutting element may be lower than the outer cutting elements. In some applications, the rows of cutting teeth of the cutting elements may be oriented parallel to one another and the planes of the cutting elements run at an acute angle to one another. In some cases, the planes of the cutting elements run at an angle of less than 5 degrees, such as from about 2 degrees to about 3 degrees. The tips of the teeth of one of the cutting elements may be lower than the tips of the teeth of at least one further cutting element in relation to the surface of the skin which is to be shaved. In certain cases, the base of the teeth of at least one of the rows of cutting teeth are lower than the base of the teeth of at least one further row of cutting teeth. In some embodiments, mutually facing side surfaces of the cutting elements are provided with a multiplicity of front recesses and/or through-passages. In certain cases, adjacent rows of cutting teeth have different spacings.

An object is to provide a shaving system which treats the skin gently and has a central cutter, the cutting properties of which can optimize cutting performance even during shaving of beard hairs which rest directly against the skin.

Aspects may include one or more of the following advantages. The cutting elements of the long-hair cutter, these elements being of comb-like design and being oriented perpendicularly to the skin, make it possible, in some cases, both for the skin to be pulled tight and for the beard hairs which are to be cut to be combed on a preliminary basis. Beard hairs projecting from the skin may be pre-combed by the long-hair cutter and turned over in the direction of the skin. The skin here may be simultaneously pulled tight by way of the contact by means of the comb-like cutting elements. In some embodiments, practical shaving tests have shown that the orientation of the cutting elements may not have any adverse effects on the gentle treatment of the skin during shaving.

In certain embodiments of the shaving system that provide the long-hair cutter having three cutting elements, it is possible for the central cutting element to be moved relative to the two outer cutting elements, allowing, in some cases, particularly thorough shaving which is particularly gentle on the skin, irrespective of the shaving direction. The cutting blade can cut on both sides between the two cutting combs. This symmetrical configuration can ensure that the beard hairs are pre-combed, and the skin is pulled tight, when the cutting comb is at rest, that is to say is not being driven, the moving cutting elements (the cutting blade) being arranged in a protected manner between the two cutting combs.

In some cases, the rows of cutting teeth of the cutting elements are advantageously oriented parallel to one another with the planes of the cutting elements arranged at an acute angle to one another, this may result in a friction-reducing line of contact between the cutting elements. Preferably, the angle is less than 5°, such as 2–3°.

In some embodiments, it is advantageous for the draw-in behavior of beard hairs if the tips of the teeth of one of the cutting elements are lower than the tips of the teeth of at least one further cutting element in relation to the surface of the skin which is to be shaved. In some of these embodiments, in order to achieve optimum gentle treatment of the skin and the best possible draw-in behavior of the beard hairs, irrespective of the shaving direction, it is advantageous if the central cutting element is lower than the outer cutting elements.

In some cases, in order for hair which has been cut off or drawn in to be removed as quickly as possible from the cutting region, it is advantageous if the base of the teeth of at least one of the rows of cutting teeth is lower than the base of the teeth of at least one further row of cutting teeth.

In some embodiments, mutually facing side surfaces of the cutting elements are provided with a multiplicity of recesses and/or through-passages. This configuration, on the one hand, may make it possible to accommodate lubricants for reducing friction and, furthermore, these profiled side surfaces may make it possible for a hair which has passed between them to be comminuted, and thus removed, by the relative movement between the cutting elements. This may make it possible to prevent the cutting elements from bending or swinging open in the cutting region.

In certain embodiments, in order to avoid catching of the cutting teeth and in order for the cutting actions to be distributed along the rows of cutting teeth, adjacent rows of cutting teeth with different spacings are provided.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
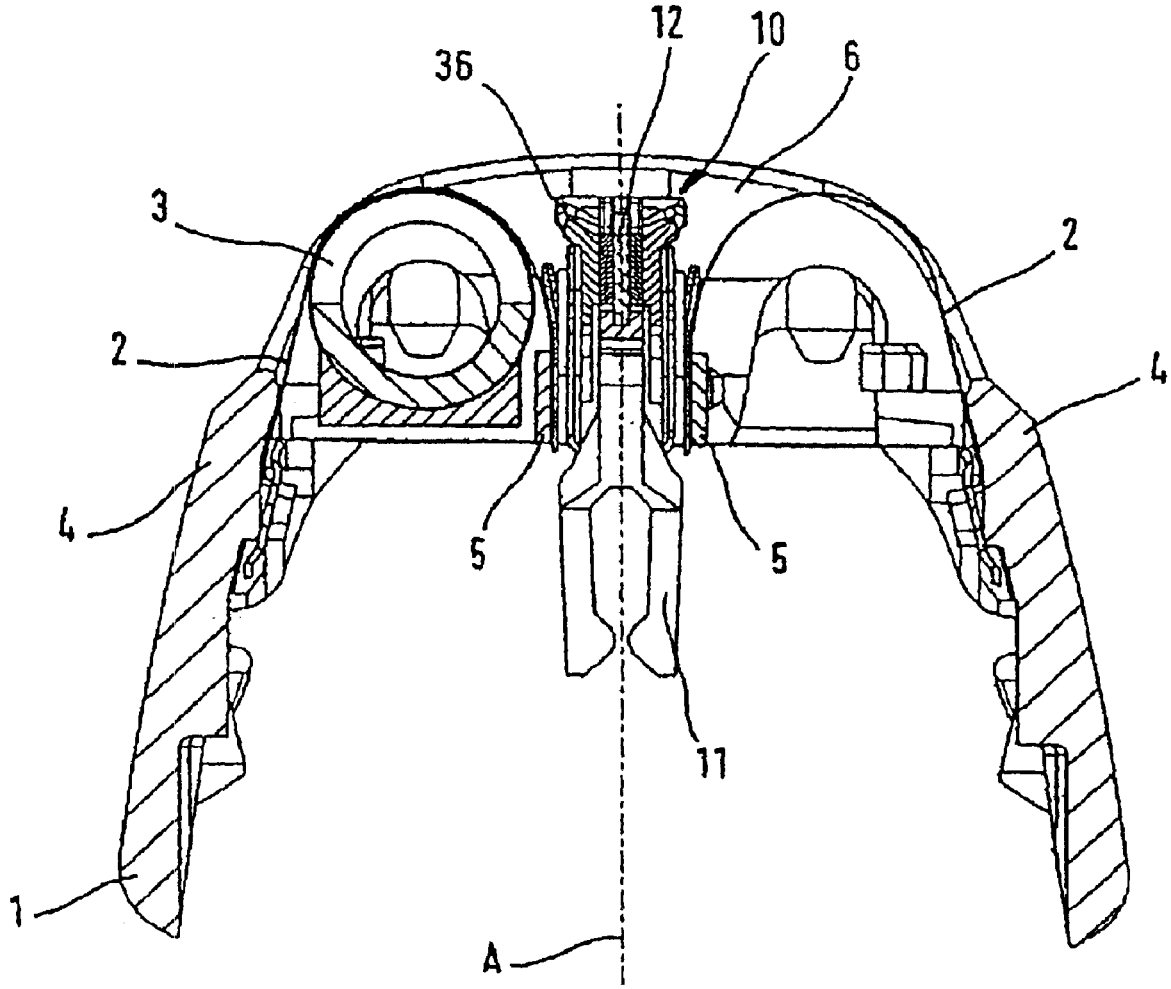
FIG. 1 shows a cross section through an embodiment of a shaving system.
Figure 2:
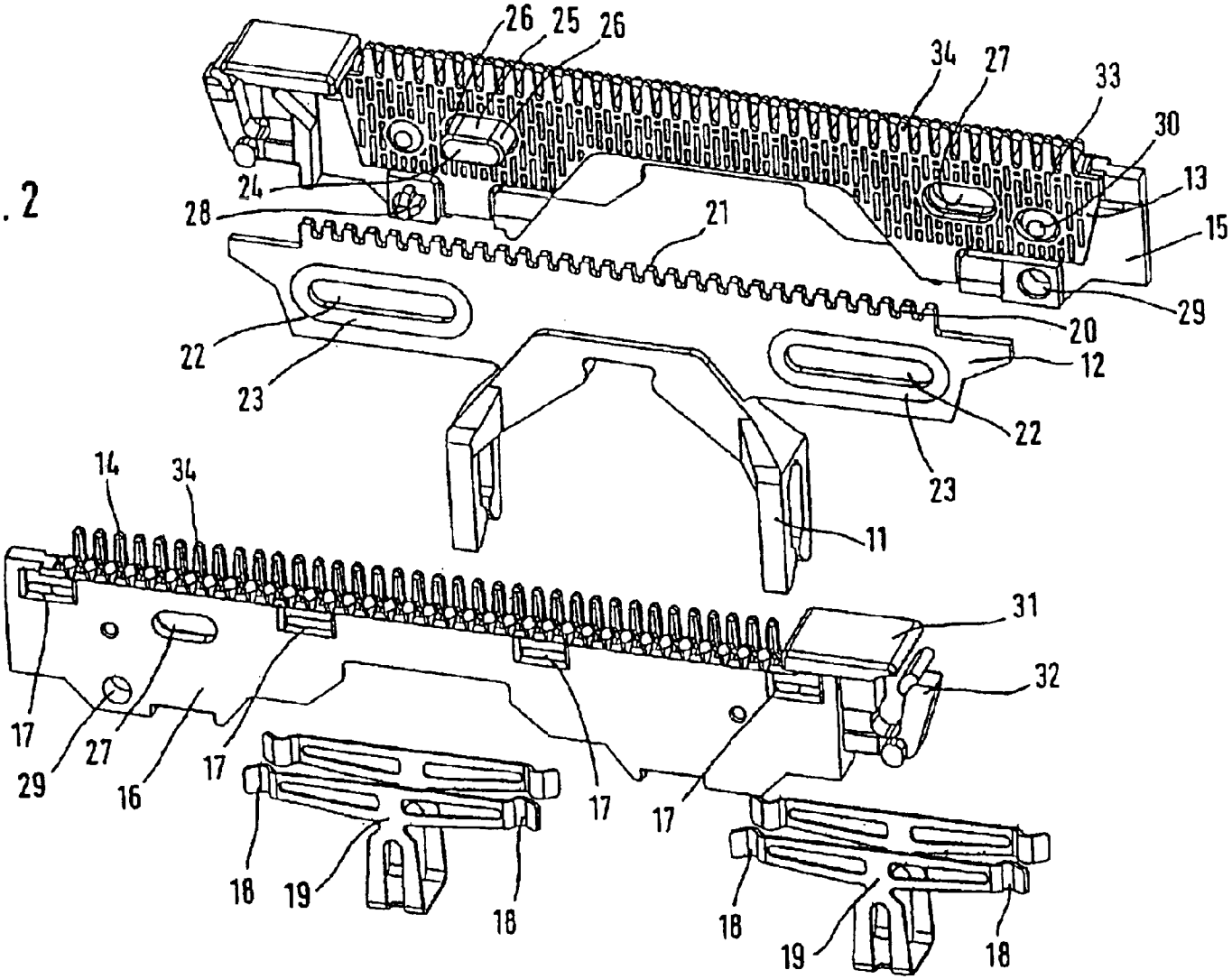
FIG. 2 shows an exploded illustration of a central cutter.

FIG. 1 shows a cross section through a shaving system in the form of a shaving head as an exchangeable frame 1, which can be connected to the housing of a dry shaver. The exchangeable frame 1 bears two shaving foils 2 which are curved in a U-shaped manner and, together with in each case one associated lower blade 3, which can be driven in oscillation by a corresponding drive of the dry shaver, for example in the form of a crank drive or of an eccentric which is driven by an electric motor provided in the housing of the dry shaver, form the two shaving units for short-hair cutting.

The lower blades 3 are designed as blade-tube blocks which are produced from a tubular steel element which has been processed by a multiplicity of transversely running slits, extending approximately over half the diameter, such that the remaining crosspieces form sharp-edged blade members. Fitted on that side of the lower blades 3, which are directed away from the shaving foil 2, are respective coupling elements, which bring the lower blades into engagement with the drive in the assembled state.

The drawing merely shows one of the two lower blades 3. For the sake of clarity, the drive and the housing of the dry shaver have not been illustrated in the drawing either.

The two shaving foils 2 are each fastened, by way of their downwardly oriented legs, on one of two outer crosspieces 4 and one of two inner crosspieces 5 of the exchangeable frame 1 of the shaving head, which is symmetrical in relation to the center plane A. The outer crosspieces 4 and inner crosspieces 5 are connected to one another by side sections 6 of the exchangeable frame 1.

Arranged centrally between the two shaving foils 2, which together with the associated lower blades 3 form the cutting units for short-hair cutting, is the long-hair cutter 10, which is connected to the side sections 6 of the exchangeable frame 1 by means of a clip-in connection. The long-hair cutter 10 will now be described in more detail, in respect of structure and function, with reference to the following FIGS.

Referring to FIGS. 1–5, a coupling element 11 is shown which is fixed to a central cutting element, namely a cutting blade 12, it being the case that the coupling element 11, once the exchangeable frame 1 has been fastened on the housing of the dry shaver, is brought into engagement with the drive of the dry shaver for the oscillating actuation of the cutting blade 12. This engagement can take place either directly or indirectly, for example by virtue of the cutting blade 12 being coupled into a component which is connected to one of the lower blades 3. As can be gathered from FIG. 2, the cutting blade 12, which can be driven in oscillation, is provided between two outer cutting elements, cutting combs 13 and 14, which are arranged at a fixed location in the exchangeable frame 1.

The cutting blade 12 and the two cutting combs 13 and 14 are produced from, e.g., a sheet steel, while the coupling element 11 consists of, e.g., plastic. The cutting combs 13 and 14 are connected to a respective plastic support 15, 16. The two subassemblies made up of cutting combs 13, 14 and respective plastic supports 15, 16 are of substantially identical configuration, so that two of them can be used for each long-hair cutter 10, as a result of which the number of parts used can be reduced. Since these structures are substantially identical, the description of individual elements of this subassembly also applies to the corresponding second subassembly.

On the sides which are directed away from the cutting combs 13, 14, the plastic supports 15, 16 have recesses 17 for accommodating curved ends 18 of clips 19, which press the two outer cutting elements, under elastic prestressing, against the central cutting element. The clips 19 thus make it possible both for a prestressing force to be produced and for the long-hair cutter to be pre-assembled.

The cutting blade 12 has a row 20 of teeth which is oriented upward and, in the assembled state, out of the shaving head and of which the teeth 21 are directed away from the coupling element 11. The cutting blade 12, furthermore, is provided with two slots 22 extending parallel to the row 20 of teeth. These slots 22 are lined with a border 23 made of plastic. By means of the slots 22, the cutting blade 12 is guided on guide bolts 24, with the result that only limited displacement parallel to the row 20 of teeth is possible. The guide bolts 24 have planar running surfaces 25, which extend in the same direction as the slots 22, and two semicircular end regions 26. Each plastic support 15, 16 has such a guide bolt 24, which extends through the corresponding cutting comb 13, 14. Following assembly, it engages in a corresponding recess 27 in the complementary plastic support.

For accurately fitting assembly and fastening of the two plastic supports 15 and 16 with one another, use is made of a star-shaped clamping pin 28, which extends in the same direction as a guide bolt 24 and, for clamping purposes, is pressed into a bore 29 in the plastic supports. Offset in the laterally outward direction in relation to recesses 27 and/or the guide bolt 24, the cutting combs 13, 14 have through-passage bores into which project rivet heads 30, which are integrally formed on the plastic support 15, 16. These serve for fastening the cutting combs on the plastic supports and are heated by means of, e.g., a so-called hot-caulking operation during assembly and are then deformed like a rivet head 30 such that there is nothing protruding beyond the cutting combs in the direction of the cutting blade, in order to ensure free displacement of the cutting blade 12 relative to the cutting combs 13; within the through-passage bores, however, the rivet heads 30 are deformed such that a radial clamping force remains between the plastic part and the metal cutting comb. The plastic supports 15, 16, however, may also be integrally formed, e.g., by injection molding, directly on the cutting combs 13, 14.

Each plastic support has a lateral covering 31, which closes the space between the two shaving foils 2 following installation of the long-hair cutter, and an elastically deformable latching hook 32, which serves for latching the long-hair cutter, once assembled, to the two side sections 6 of the exchangeable frame 1.

That surface of the cutting comb 13 and 14 which is directed toward the cutting blade 12 in each case is provided with a multiplicity of recesses 33 in order, for example, on the one hand, to accommodate lubricants for reducing friction; on the other hand, bits of hair which have passed between these contact surfaces are also very rapidly comminuted as a result, this preventing a gap in the cutting region or preventing the cutting combs or the blade from being bent open by a beard hair which has passed into this contact region.

Figure 5:
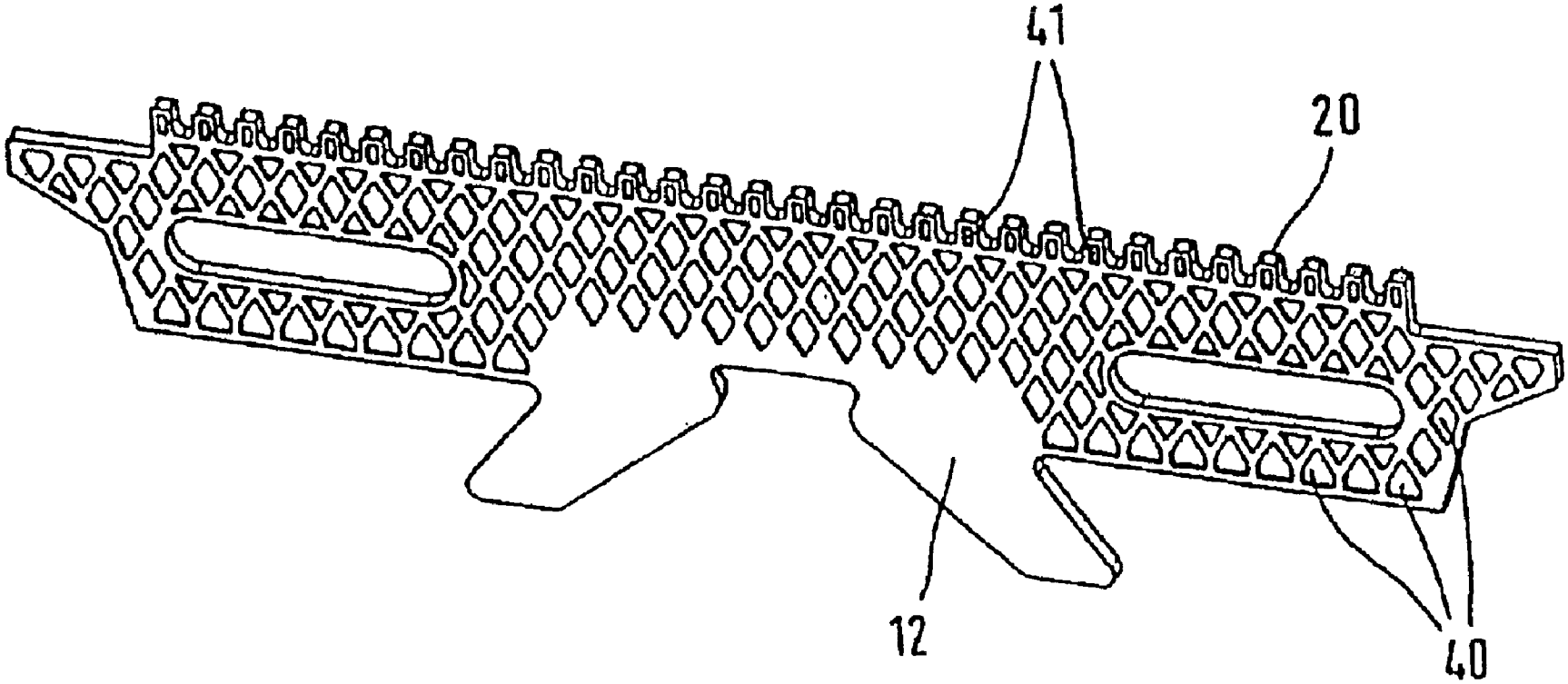
FIG. 5 shows a perspective illustration of an embodiment of a central cutting blade.

FIG. 5 shows a cutting blade 12 with a multiplicity of recesses 40, which may also be designed as through-passages, on the two surfaces directed toward the associated cutting combs 13, 14. Furthermore, the teeth of the row 20 of teeth are provided with through-passages or recesses 41, as a result of which the effect which has just been mentioned may be further enhanced. Both the recesses and the through-passages are produced by means of etching.

Rows 34 of teeth of the cutting combs 13, 14 are designed with a considerably greater tooth height than the row 20 of teeth of the cutting blade 12. In the assembled state, the tips 35 of the teeth of the rows 34 of teeth project beyond the tips of the teeth of the row 20 of teeth, which may, along with relatively gentle treatment of the skin, comb the beard which is to be shaved particularly well and any beard hairs which rest flat against the skin may be made to stand upright. This difference in height of the tips of the teeth is shown clearly, in particular, in FIG. 4. In order for it to be possible for beard hairs, once cut off, to be removed relatively quickly from the cutting region, the base of the teeth of the rows 34 of teeth of the cutting combs 13, 14 is located at a considerably lower level, that is to say by approximately 1 to 1.5 mm, than the base of the teeth of the row 20 of teeth of the cutting blade. As a result of this difference in the level of the respective bases of the teeth, a beard hair which has been cut off in the cutting region automatically falls outward and thus cannot obstruct further cutting operations.

Figure 4:
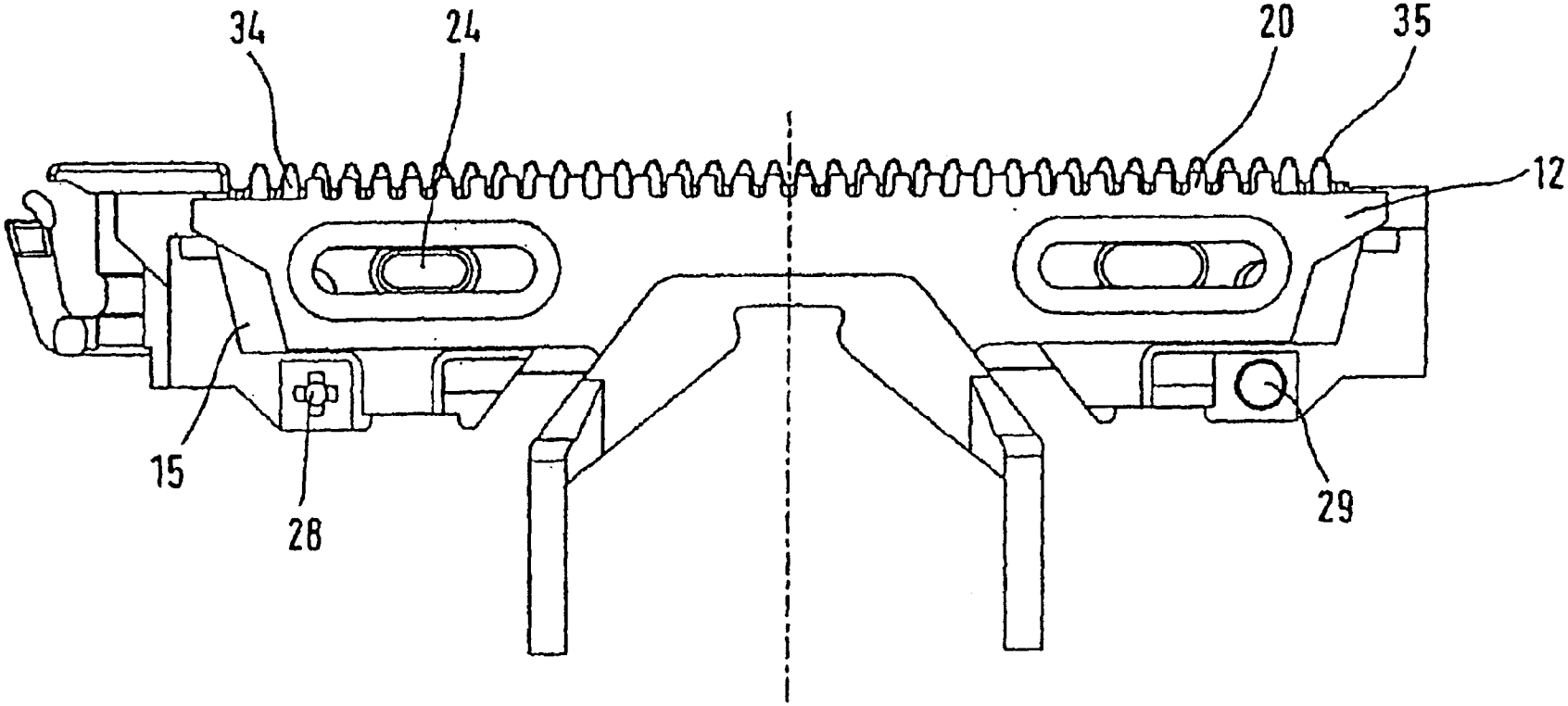
FIG. 4 shows an embodiment of a partially assembled long-hair cutter.

As is illustrated, in particular, in FIG. 4, the spacing of the row 20 of teeth is somewhat greater than the spacing of the row 34 of teeth, this preventing catching between the cutting blade 12 and the cutting combs 15, 16. At the same time, this difference in the spacings can provide that not all cutting actions along the rows of teeth take place at the same time, as a result of which smoother running may be established.

It can be seen in FIG. 1 that the cutting blade 12 is oriented such that it ends up located in the center plane A. In contrast, in the case of one embodiment of the long-hair cutter 10, the cutting combs 13, 14, which are arranged to the sides of the cutting blade, are positioned outward such that they form an acute angle which is open in the downward direction. A deviation from the center plane A here is only a few degrees. This slightly oblique positioning of the cutting combs 13, 14 relative to the cutting blade 12 results in merely a line of contact between the metal parts which slide on one another, this reducing the friction which occurs to a considerable extent in relation to planar contact.

As skin protection and in order for the beard hairs which are to be cut to be pre-combed in a manner which is particularly gentle on the skin, combs 36 which are arranged in front of the rows 34 of teeth and have a rounded contour and a spacing which is identical to that of the rows 34 of teeth are integrally formed on the plastic supports 15, 16. By virtue of these combs 36 being correspondingly pressed onto the skin which is to be shaved, it is also possible for the skin to be pulled tight during shaving, this aiding a relatively optimal cutting result. For this purpose, it is particularly advantageous if the teeth of the combs 36 are positioned outward by an angle of approximately 45° in relation to the teeth of the row 34 of teeth, that is to say in the front and rearward directions as seen in the view shown in FIG. 3.

Figure 3:
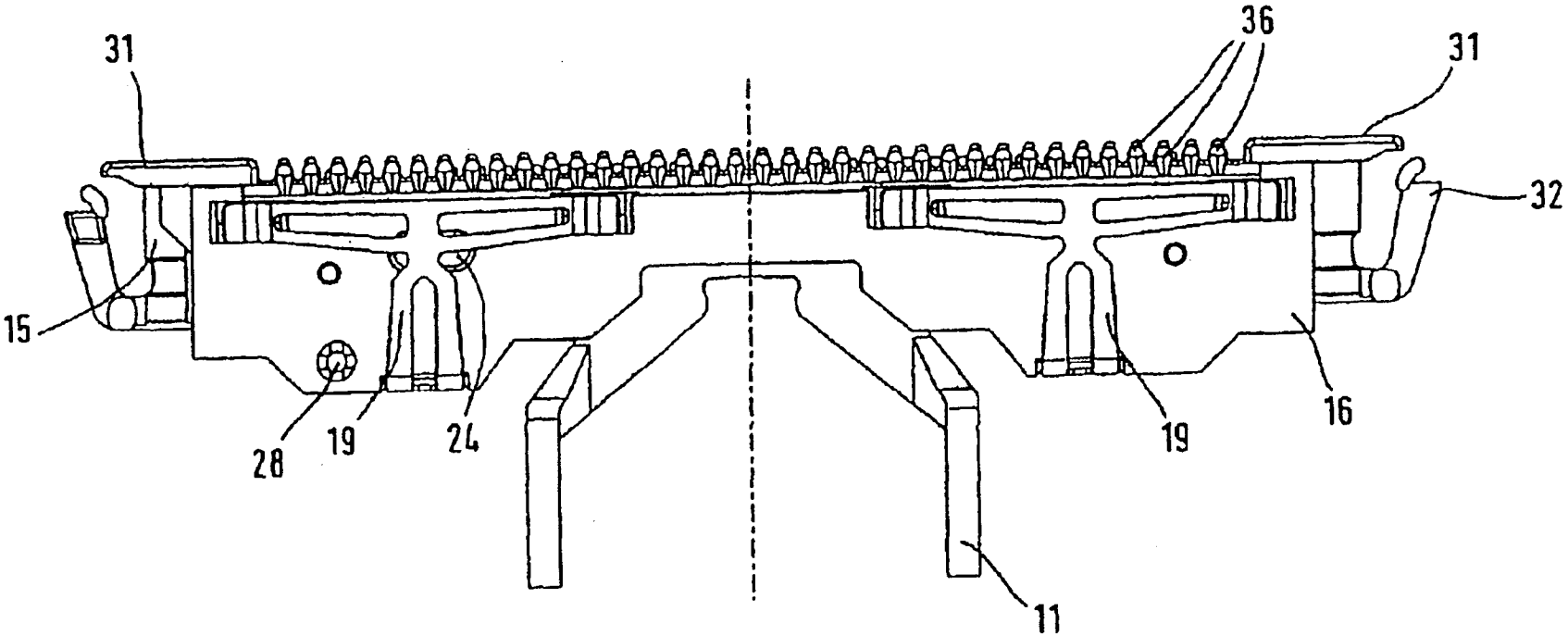
FIG. 3 shows a side view of the long-hair cutter according to FIG. 2 in an assembled state.

As FIG. 3 shows, the teeth of the rows 34 of teeth of the cutting combs 13, 14 and those of the combs 36 arranged in front of the same are aligned with one another, with the result that, in the view illustrated there, the teeth assigned to the cutting comb 13 and also the teeth of the combs 36 are concealed by the teeth assigned to the cutting comb 14. A further embodiment of the long-hair cutter (not illustrated in the drawing), however, is distinguished in that the above-mentioned teeth are offset. The maximum offset here would thus be half the spacing of the rows 34 of teeth. This offset achieves the situation where, when the shaver is passed over the skin which is to be shaved, it is highly probable that no hair passes the long-hair cutter without being subjected to the action of one of the combs 36 or of the cutting combs 13, 14. This measure can provide that, in particular, even all of the hairs which rest flat against the skin and are oriented in the shaving direction come up against an obstruction, that is to say a comb tooth, as a result of which they can be raised and cut.

During shaving, in a first instance, the short-hair cutting system, which comprises the shaving foil and the associated lower blade 3, is used to shave short hairs, while longer hairs, which possibly also rest flat against the skin, are oriented in the shaving direction by the long-hair cutter 10 and cut off between the cutting combs 13, 14 and the cutting blade 12. The beard hair which has been shortened by the long-hair cutter 10 is then shaved thoroughly by the short-hair cutting system which follows the long-hair cutter.

A number of embodiments of the invention have been described. Nevertheless, it will be understood that various modifications may be made without departing from the spirit and scope of the invention. Accordingly, other embodiments are within the scope of the following claims.

What is claimed is:

1. A shaving system for a dry shaver comprises at least one long-hair cutter arranged between shaving units for short-hair cutting, the shaving units for short-hair cutting each comprising an upper blade and a lower blade, which can be moved relative to one another by a drive, and the long-hair cutter comprising three cutting elements that can be moved relative to one another and are arranged one beside the other, the cutting elements of the long-hair cutter each of comb-like design, and their rows of cutting teeth, which are formed by tines, are oriented essentially perpendicularly to the skin which is to be shaved wherein a central one of the cutting elements is movable relative to two outer cutting elements.

2. The shaving system of claim 1, the central cutting element is lower than the outer cutting elements.

3. The shaving system of claim 1, wherein the rows of cutting teeth of the cutting elements are oriented parallel to one another and planes of the cutting elements run at an acute angle to one another.

4. The shaving system claim 3, wherein the angle is less than 5 degrees.

5. The shaving system of claim 4, wherein the angle is from about 2 degrees to about 3 degrees.

6. The shaving system of claim 3, wherein the central cutting element is lower than the outer cutting elements.

7. The shaving system of claim 1, wherein a base of the teeth of at least one of the rows of cutting teeth is lower than a base of the teeth of at least one further row of cutting teeth.

8. The shaving system of claim 1, wherein mutually facing side surfaces of the cutting elements are provided with a multiplicity of front recesses.

9. The shaving system of claim 1, wherein mutually facing side surfaces of the cutting elements are provided with a multiplicity of through-passages.

10. The shaving system of claim 1, wherein adjacent rows of cutting teeth have different spacings.

* * * * *